US006024833A

United States Patent [19]

Wennberg

[11] Patent Number: 6,024,833

[45] Date of Patent: Feb. 15, 2000

[54] PROCESS FOR REMOVING METALS AND RECOVERING A CHELATING AGENT FROM A BLEACH PLANT WASTE LIQUOR

[75] Inventor: Olle Wennberg, Gothenburg, Sweden

[73] Assignee: Kvaerner Pulping Ab, Karlstad, Sweden

[21] Appl. No.: 08/850,737

[22] Filed: May 2, 1997

Related U.S. Application Data

[63] Continuation of application No. PCT/SE95/01281, Oct. 31, 1995.

[30] Foreign Application Priority Data

Nov. 4, 1994 [SE] Sweden ..... 9403779

[51] Int. Cl.[7] ..... D21C 11/00; D21C 11/04; D21C 11/10

[52] U.S. Cl. ..... 162/16; 162/30.1; 162/32; 162/37; 162/76; 159/47.3; 210/712; 210/737; 210/928

[58] Field of Search ..... 162/76, 78, 79, 162/38, 39, 40, 16, 37, 30.1, 32, 30.11, 29; 210/912, 774, 712, 737, 928; 159/47.1, 47.3

[56] References Cited

U.S. PATENT DOCUMENTS

| | | | |
|---|---|---|---|
| 5,145,557 | 9/1992 | Peter et al. | 162/40 |
| 5,509,999 | 4/1996 | Lindberg | 162/29 |
| 5,540,816 | 7/1996 | Andtbacka et al. | 162/29 |

FOREIGN PATENT DOCUMENTS

| | | | |
|---|---|---|---|
| 0 402 335 | 12/1990 | European Pat. Off. . | |
| 28 342 596 A1 | 2/1979 | Germany . | |
| WO 94/21857 | 9/1994 | WIPO . | |
| WO 94/23122 | 10/1994 | WIPO | D21C 9/10 |
| WO 95/04188 | 2/1995 | WIPO | D21C 11/00 |

OTHER PUBLICATIONS

T. Grace, "Evaporator Scaling", Southern Pulp and Paper Manufacturer, vol. 40, No. 8, Aug. 1977.

R. Schleinkofer, "Overview of a Chlorine–Free Bleaching Process", Seminar Notes of the Technical Association of the Pulp and Paper Industry, Denver Hilton, Oct. 21,19981.

Lindberg, Strategies for Metal Removal Control in Closed Cycle Mills, 1994 International Pulp Bleaching Conference, Hyatt Regency Hotel, Vancouver, British Columbia, pp. 293–302.

*Primary Examiner*—Steven Alvo

*Attorney, Agent, or Firm*—Jeffrey S. Melcher; Farkas & Manelli, PLLC

[57] ABSTRACT

Provided is a process for removing metals from a bleaching plant spent liquor and recovering a chelating agent which includes the steps of: heating a spent liquor containing a chelate comprising metals bound in a chelating agent to a temperature of at least about 140° C. to break bonds in the chelate and release metals from the chelate; increasing the content of at least one of carbonate or sulphide in an alkaline material comprising at least one of green liquor or white liquor to form a carbonate or sulphide enhanced alkaline material; contacting the heated spent liquor with the alkaline material to form a solution containing precipitated metals, wherein the alkaline material is added in an amount sufficient to precipitate a majority of the released metals out of the solution; filtering the solution to separate the precipitated metals from the solution and form a filtrate containing recovered chelating agent; and supplying at least a portion of the recovered chelating agent to a chelating washing stage in a bleaching plant to bond with metals released from pulp and form a chelate. Also provided is a method of reducing encrustations.

10 Claims, 1 Drawing Sheet

PROCESS FOR REMOVING METALS AND RECOVERING A CHELATING AGENT FROM A BLEACH PLANT WASTE LIQUOR

This application is a continuation of No. PCT/SE95/01281 filed on Oct. 31, 1995, and claims priority to Swedish patent application SE9403779-3 filed on Nov. 4, 1994, the complete disclosures of which are incorporated herein by reference.

1. TECHNICAL FIELD

The invention relates to a method for precipitating undesirable metals from pulp mill, spent liquors. The invention also relates to a method of reducing encrustations on evaporator equipment.

2. BACKGROUND OF THE INVENTION

Due to the increasing interest in the environment and understanding of the ecological cycle in nature, there is a great desire among both consumers and producers to decrease discharges of pollutants arising as a consequence of human activity. Therefore, vigorous efforts have been made to decrease the discharges from pulp and paper mills.

One aim has been to create a closed pulp mill in which there are no discharges from the pulp mill. In a closed pulp mill, the process chemicals are recovered from the spent liquors and reused. A problem associated with a closed pulp mill has been making it possible to return bleaching department spent liquors in countercurrent to the pulp in those cases where the spent liquors contain chlorine chemicals from a bleaching stage, which is based on chlorine gas or chlorine dioxide. Successful attempts have been made to circumvent this problem by avoiding chlorine-containing chemicals, and instead using hydrogen peroxide or ozone as bleaching chemicals.

Another problem has been the risk of certain non-process elements, for example ions of transition metals, which are supplied to the process together with the raw wood material, building up in high concentrations in the system when the spent liquors are returned. Such metal ions are often chelated, especially prior to a sensitive hydrogen peroxide bleaching stage where there is the risk that the peroxide will be decomposed by the metal ions. However, when filtrate from a washing stage which succeeds such a chelating stage is returned in countercurrent, there is the risk that the metal ions will be returned to the pulp by means of precipitating out on the pulp.

An alternative to returning the bleaching department spent liquor in countercurrent to the pulp is to convey the spent liquor to the mixing department where it can be used as washing water, or to the soda smelt dissolver, where it can be used as make-up water. However, the quantity of spent liquor is usually too great for these uses, and, as a result, evaporation is necessary. A problem with this is that the spent liquor from a chlorine gasfree or chlorine dioxide-free bleaching department can contain large quantities of calcium which may precipitate out when the spent liquor is evaporated and form undesirable encrustations on the equipment.

Swedish patent No. 417 114 attempts to solve the encrustation problem by adding a metal compound that is able to chelate encrustationforming negative ions.

Southern Pulp and Paper Manufacture, 40/1977, No.8, pages 16–36, "Evaporator Scaling", T. Grace, discloses a method for "thermally deactivating" calcium in black liquor in order to avoid encrustation formation. This method consists of heat-treating the black liquor, to which calcium carbonate has been added to act as crystallization nuclei, at 150° C. for 10–15 minutes. The theory being the method is that the calcium in the black liquor is bound to organic substances, for example dissolved lignin and oxalate ions. During the heat treatment, the complex is broken down and the calcium ions precipitate out due to reaction with the carbonate ions which are naturally present in the black liquor. Calcium carbonate in solid (precipitated) form is not regarded as a cause of encrustation formation when liquid which contains such a precipitate is evaporated. Encrustations are only formed if the calcium carbonate precipitates out directly onto the hot heat-transfer surfaces of the evaporator. This method has been found to be successful in preventing encustation but cannot be directly applied to the bleaching department spent liquors since the neutral content of carbonate ions is low.

Thus, there is a need for a method of reducing encrustations on the evaporator equipment caused by evaporating a bleaching plant spent liquor containing calcium.

SUMMARY OF THE INVENTION

An objective of the present invention is to provide a method for removing metals from a bleaching plant spent liquor in combination with recovering a chelating agent.

Another objective of the present invention is to provide a method for reducing encrustations on evaporator equipment caused by evaporating a bleaching plant spent liquor containing metals.

The above objectives and other objectives can be obtained by the following. Provided is a novel process for removing metals from a bleaching plant spent liquor and recovering a chelating agent comprising the steps of:

- heating a spent liquor containing a chelate comprising metals bound in a chelating agent to a temperature of at least about 140° C. to break bonds in said chelate and release metals from the said chelate;
- increasing the content of at least one of carbonate or sulphide in an alkaline material comprising at least one of green liquor or white liquor to form a carbonate or sulphide enhanced alkaline material;
- contacting said heated spent liquor with said alkaline material to form a solution containing precipitated metals, wherein said alkaline material is added in an amount sufficient to precipitate a majority of said released metals out of said solution;
- filtering said solution to separate said precipitated metals from said solution and form a filtrate containing recovered chelating agent; and
- supplying at least a portion of said recovered chelating agent to a chelating washing stage in a bleaching plant to bond with metals released from pulp and form a chelate.

The invention also provides a novel process for reducing encrustations on evaporator equipment caused by evaporating bleaching plant spent liquor a chelating agent comprising the steps of:

- contacting a bleaching plant spent liquor with an alkaline solution comprising at least one of green liquor or white liquor to cause a metal present in the spent liquor to precipitate out of solution and form solid precipitate particles suspended in said spent liquor; and
- evaporating said spent liquor, wherein said precipitate particles behave as nuclei for crystallization of metals from solution during evaporation

DETAILED DESCRIPTION OF PREFERRED EMBODIMENTS

Figure 1:
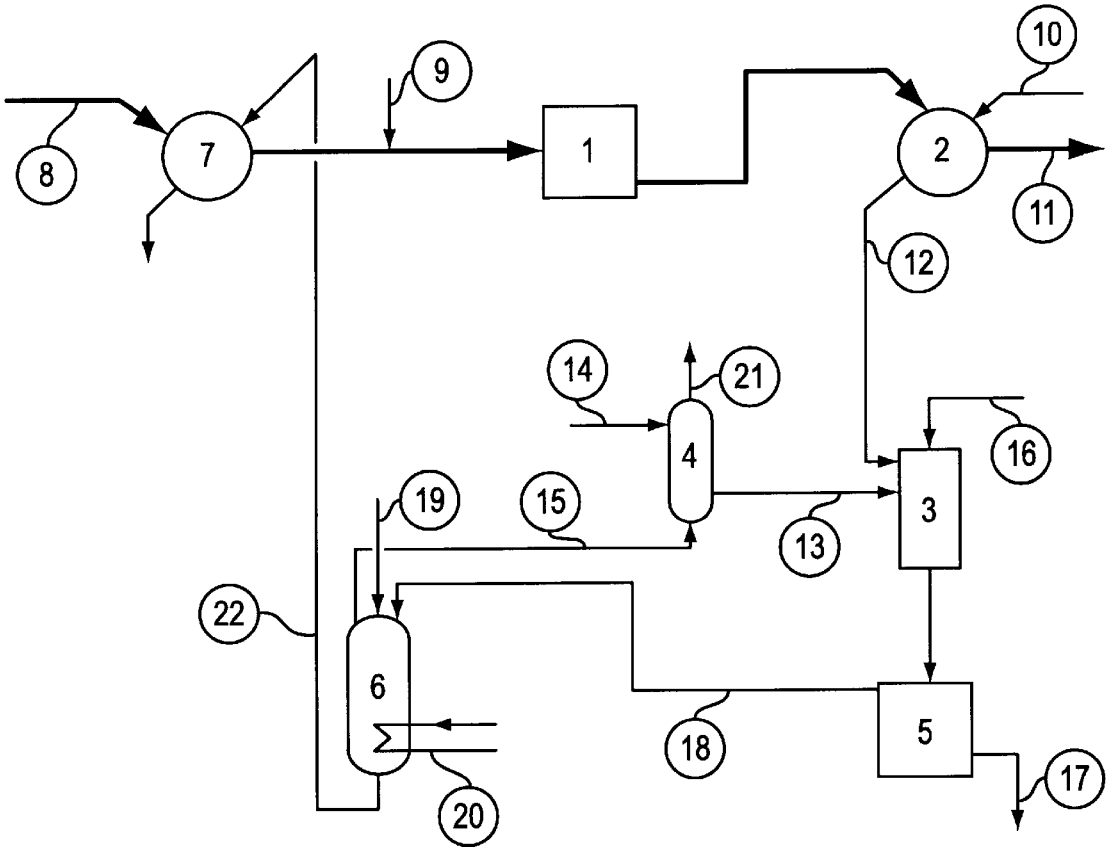
FIG. 1 illustrates a process according the present invention in which transition metals and alkaline earth metals are separated out of bleaching department spent liquor from a chelating stage.

It has now been found that undesirable metals can be removed from a bleaching plant spent liquor and a chelating agent can be recovered. An embodiment of the present invention relates to precipitating out transition metals and alkaline earth metals which are present in bleaching plant spent liquors by adding an alkaline liquid which comprises green liquor and/or white liquor. The filtrate from a chelating stage, which makes use of EDTA, for example, for chelating transition metals which are harmful to the bleaching process, will contain the majority of these metals as well as alkaline earth metals such as calcium. This filtrate therefore represents a suitable point in the process for separating off these metals.

Anions such as $OH^-$, $H^{2-}$, and $CO_3^{2-}$ form mostly insoluble salts with the majority of transition and alkaline earth metals. Media in which such anions naturally occur, for example green liquor and white liquor, are present in the pulp mill. In accordance with the present invention, these media are used for precipitating the metals.

According to the one aspect of the present invention, a method is provided for precipitating transition metals, in particular manganese, iron and copper, from the bleaching department spent liquor from a chlorine-free bleaching process so that these metals can be separated off by, for example, filtration or flotation. The spent liquor which has been purified in this way can then, if so desired, be returned in countercurrent to the pulp without the risk of metals precipitating out on the pulp.

The precipitation can be conducted by adding green liquor or white liquor. Preferably, carbon dioxide and/or hydrogen sulphide has been supplied to green liquor or white liquor in order to obtain an enhanced content of carbonate and/or sulphide in the liquor. Lime sludge, burnt lime or slaked lime, for example, can also be added to the precipitation reactor in order to improve the precipitation conditions and adjust the pH.

If the bleaching department spent liquor is derived from a chelating stage or a washing stage subsequent to such a stage, the bonds in the chelate can be broken by heat-treating the liquor at a temperature of at least about 140° C., preferably from about 150 to about 170° C.

The precipitates which form can be separated off and the filtrate treated with an acidic solution, preferably sulphuric acid, whereupon hydrogen sulphide and carbon dioxide are driven off, after which they can be absorbed once again into green liquor or white liquor. Remaining gases which have not been absorbed can be conveyed to a destruction point. Remaining hydrogen sulphide can be combusted to form sulphur dioxide or sulphur trioxide which can then replace some of the sulphuric acid which is used. Precipitate which has been separated off can be destroyed in the bark boiler, for example, in connection with which it forms an ash that can be deposited.

An advantage of this embodiment of the invention is that when the treated bleaching department spent liquor derives from a chelating stage, the chelating agent, for example EDTA, can to a large extent be regenerated. This chelating agent can then be reused for bonding with metals released from the pulp to form a chelate when the filtrate is returned in countercurrent.

An additional advantage of this embodiment is that the addition of hydrogen sulphide and carbon dioxide has the effect of significantly increasing the content of sulphide and carbonate in the green liquor or white liquor, resulting in the quantity of green liquor or white liquor which is required being about one third of the quantity which would otherwise have been required in order to bring about the desired precipitation. Furthermore, the addition of hydrogen sulphide and carbon dioxide can even increase the content of sulphide and carbonate in the green liquor or white liquor to such an extent that the quantity of green liquor or white liquor which is required is only about one half of the quantity which would otherwise have been required in order to bring about the desired precipitation. An additional advantages is that the quantity of sulphuric acid which is used for neutralizing the green liquor can also be reduced by one third or one half.

According to another aspect of the invention, a method is provided for precipitating alkaline earth metals, especially calcium, out from a chlorine-free bleaching plant spent liquor to substantially reduce the risk of these metals of precipitating out during an evaporation process and forming encrustations on the evaporator equipment.

There can be an abundant quantity of calcium in bleaching department spent liquor from a chlorine-free bleaching process, and this calcium can often be present in dissolved form, especially if use is made of an acidic washing stage. For example, if sulphuric acid is used, a solution of calcium sulphate can be obtained even after neutralizing the spent liquor. While the solubility of calcium sulphate is relatively low, it is greater than that of calcium carbonate. Furthermore, even though the presence of oxalate ions can result in substantially insoluble calcium oxalate being precipitated, the quantity of oxalate in the spent liquor is seldom sufficient to precipitate out a large portion of the calcium present in solution.

According to this embodiment of the invention, dissolved calcium is precipitated out by adding green liquor and/or white liquor, resulting in the formation of particles of calcium carbonate suspended in solution. The solubility of calcium carbonate is about 100 times lower than that of calcium sulphate. A relatively small quantity of green liquor can provide a substantial excess of carbonate ions, so that a large proportion of the calcium, usually greater than about 90%, can be precipitated out of solution. Some of the calcium can be bound to a chelating agent. In a similar manner as to that described above, the bonds between the chelating agent and the calcium can be broken by heat-treating the liquor at a temperature of at least about 140° C., preferably from about 150 to about 170° C., prior to or in conjunction with the evaporation step. Preferably, the heat-treatment and precipitation step is conducted before the evaporation step. Furthermore, the carbonate and sulphide concentration of the green liquor and/or white liquor can be enhanced prior to the precipitation step, in a similar manner as that described herein above.

In this embodiment, surprisingly the precipitate which has been formed does not have to be separated off since it behaves like crystallization nuclei for ongoing precipitation and thereby assists in preventing undesirable precipitation on the heat-transfer surfaces of the evaporator. Where appropriate, additional lime can be added in the form of burnt lime or lime sludge in order to provide further crystallization nuclei. The bleaching department spent liquor can also be mixed with other cellulose spent liquor during the course of the evaporation.

An advantage of this embodiment of the invention is that the increased alkalinity due to the addition of green liquor provides favorable conditions for dissolving organic substances such as resins. The latter can otherwise smear heat transfer surfaces or other apparatus parts.

The invention will now be explained in detail with reference to the attached Figures. FIG. 1 illustrates a preferred example a bleaching sequence according to the present invention. First, the pulp stream shown at 8 passes through the washing stage 7. In a following stage 1, at least one chelating agent, preferably EDTA, is added to the pulp stream to chelate metals present in the pulp stream. In stage 2, the chelating agent containing bound metals, which is usually soluble, is washed out of the pulp stream, shown at 11. A spent liquor from a hydrogen peroxide stage can be used as the washing liquid in stage 2, shown at 10. The chelating agent accompanies the filtrate shown at 12 from the washing stage 2 to a precipitation reactor shown at 3. A stream shown at 13 is also supplied to this reactor. This stream 13 comprises green liquor and/or white liquor shown at 14. The stream 13 is contacted with carbon dioxide and hydrogen sulphide, at 15, in a countercurrent column 4 for the purpose of increasing the content of carbonate and sulphide in the stream of liquor 13. In the precipitation reactor 3, the different metals react with sulphide and carbonate to form precipitate particles suspended in solution. For example, calcium carbonate and manganese sulphide are formed, both of which are very difficult to dissolve. Lime sludge, or burnt or slaked lime, at 16, can be supplied to the reactor in order to adjust the pH and create more favorable precipitation conditions. The filtrate 12 can be heat-treated (not shown), for example at a temperature of about 150° C. for the purpose of breaking the chelate bonds so that the metals are released and can precipitate out of solution when the stream 13 is added to the reactor. After the precipitation, the liquid can be filtered, at 5, with the precipitation products 17 being separated off. The filtrate 18, which now contains some carbonate and sulphide and has an elevated pH, is treated with sulphuric acid 19 in a column stripper 6, resulting in carbon dioxide and hydrogen sulphide 15 being driven off. The actual stripping can be effected, for example, using stream 20. The gases which have been driven off are returned to the countercurrent column 4 to be absorbed in green liquor or white liquor. The gasses 21 which are not absorbed are conveyed onwards to a destruction point. In this connection, remaining hydrogen sulphide can be combusted to form sulphur dioxide or sulphur trioxide which can replace some of the sulphuric acid 19. Other adjustments aimed at decreasing the quantity of sulphuric acid required are also conceivable. After having been filtered 5 and treated with sulphuric acid 6, the spent liquor 22 from the column stripper is substantially free of sulphide and carbonate. The spent liquor additionally contains chelating agent which has been released from the metals and thereby regenerated. This spent liquor 22 is now returned, in countercurrent to the pulp, to washing stage 7. A large proportion of the liquid then accompanies the pulp to chelating stage 1, where the regenerated chelating agent can be used to form a chelate with metals released from the pulp once again.

Figure 2:
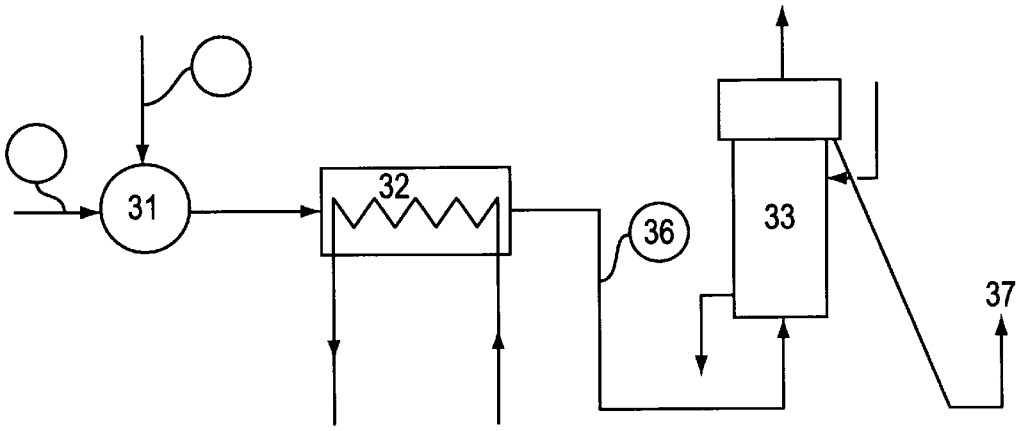
FIG. 2 illustrates a process according to the present invention in which transition metals and alkaline earth metals are separated out of bleaching department spent liquor from a chelating stage.

In an alternative embodiment of the invention, shown in FIG. 2, green liquor 14 is supplied, in stage 31, to bleaching department spent liquor 12 from a chelating stage in a chlorine-free bleaching sequence. The liquor mixture is subsequently heat-treated in stage 32 at a temperature of about 150° C. for the purpose of releasing alkaline earth metals, especially calcium, from the chelation so that the metals can react with the green liquor and precipitate out of solution, for example as solid particles of calcium carbonate suspended in solution. The liquor 36, including the precipitate, is now conveyed to evaporation 33. There is a substantially reduced risk of the calcium, which has already precipitated out in the form of solid calcium carbonate particles, forming encrustations on the evaporation equipment. Instead, the solid particles of calcium carbonate serve as crystallization nuclei for ongoing precipitation in the solution. During the evaporation, other cellulose spent liquor can also be evaporated.

After the evaporation sequence has been completed, the condensed spent liquor 37 can be supplied, for example, to the mixing department as a, washing water or to the soda smelt dissolver as make-up liquid.

The present invention will now be explained by the following non-limiting example.

EXAMPLE

When carrying out evaporation experiments on bleaching plant spent liquors from chelating stages and hydrogen peroxide stages, it has been found that substantial quantities of precipitates are formed. These precipitates have the potential of precipitating out of solution in form of undesirable encrustations on the surface of the evaporation equipment. Analysis of this precipitate demonstrates that about 10% of the precipitates consists of calcium which, as calcium sulphate and calcium oxalate, corresponds to about one third by weight of the precipitates.

Precipitation experiments were carried out at a temperature of 90° C., with green liquor being added to solutions of spent liquor form chelating stages and hydrogen peroxide stages. These concentrated solutions were diluted beforehand to COD contents of 2, 5, 10 and 20 grams/liter. Increasingly large quantities of green liquor were added to these solutions and, after each addition, a sample was taken of the mixture, which was then filtered. The quantity of soluble calcium which remained in the sample filtrate was then determined.

The best results were achieved with solutions of low COD content (2 grams of COD/liter). This COD content corresponds approximately to the content which is obtained in a bleaching department which is totally chlorine-free. Approximately 90% of the calcium was precipitated out by adding only 20 ml of green liquor per liter of bleaching department spent liquor solution. Further addition of green liquor resulted in only a small decrease in the quantity of calcium remaining in the filtrate.

The experiments clearly demonstrate that adding green liquor to the bleaching department spent liquor from chelating stages and hydrogen peroxide stages can promote substantial precipitation of calcium. The effect on transition metals such as manganese, for example, is similar.

If green liquor is used in the embodiment according to FIG. 1, only about 0.2 $m^3$ of green liquor would be required per ton of pulp if the quantity of spent liquor from the chelating stage is about 10 $m^3$ per ton of pulp. This quantity of green liquor would then require approximately 40 kg of sulphuric acid per ton of pulp for its neutralization if adjustments are not made to decrease the quantity required, such as by increasing the sulphide and/or carbonate content in the green liquor prior to precipitation of the metals.

The embodiments shown in FIGS. 1 and 2 and in the experimental description are preferred embodiments. However, while the invention has been described in detail and with reference to specific embodiments thereof, it will be apparent to those of ordinary skill in the art that various changes and modifications can be made to the claimed invention without departing from the spirit and scope thereof. For example, it will be readily evident to one of ordinary skill in the art that the concept of the invention can be used for spent liquors from another stage in the bleaching department sequence.

I claim:

1. A process for removing metals from a bleaching plant spent liquor, recovering a chelating agent, and reducing encrustations on evaporator equipment caused by evaporating bleaching plant spent liquor comprising the steps of:

heating a spent liquor containing a chelate comprising metals bound in a chelating agent to a temperature of at least about 140° C. to break bonds in said chelate and release metals from the said chelate;

increasing the content of at least one of carbonate or sulphide in an alkaline material comprising at least one of green liquor or white liquor to form a carbonate or sulphide enhanced alkaline material;

contacting said heated spent liquor with said alkaline material to form a solution containing precipitated metals;

evaporating said solution containing precipitated metals to form an evaporated solution, wherein said precipitated metals behave as nuclei for crystallization of metals from solution during evaporation;

filtering said evaporated solution to separate said precipitated metals from said solution and form a filtrate containing recovered chelating agent; and supplying at least a portion of said recovered chelating agent to a chelating washing stage in a bleaching plant to bond with metals released from pulp and form a chelate.

2. A process according to claim 1, wherein said heating step comprises heating said spent liquor to a temperature of from about 150 to about 170° C.

3. A process according to claim 1, wherein said chelating agent comprises EDTA.

4. A process according to claim 1, wherein said metal comprises calcium.

5. A process according to claim 1, wherein said step of increasing the content of at least one of carbonate or sulphide in said alkaline material comprises contacting said alkaline material with carbon dioxide or hydrogen sulphide to form a carbonate or sulphide enhanced alkaline material.

6. A process according to claim 5, wherein said step of increasing the content of at least one of carbonate or sulphide in an alkaline material comprises adding a sufficient amount of carbonate to said alkaline material to reduce by at least about one third the amount of alkaline material required to precipitate out said metal present in said solution.

7. A process according to claim 5, wherein said step of increasing the content of at least one of carbonate or sulphide in an alkaline material comprises adding a sufficient amount of sulphide to said alkaline material to reduce by at least about one third the amount of alkaline material required to precipitate out said metal present in said solution.

8. A process according to claim 5, wherein said step of increasing the content of at least one of carbonate or sulphide in an alkaline material comprises adding a sufficient amount of sulphide to said alkaline material to reduce by at least about one half the amount of alkaline material required to precipitate out said metal present in said solution.

9. A process according to claim 5, wherein said step of increasing the content of at least one of carbonate or sulphide in an alkaline material comprises adding a sufficient amount of carbonate to said alkaline material to reduce by at least about one half the amount of alkaline material required to precipitate out said metal present in said solution.

10. A process according to claim 5, wherein said step of increasing the content of at least one of carbonate or sulphide in an alkaline material comprises adding a sufficient amount of sulphide and carbonate to said alkaline material to reduce by at least about one half the amount of alkaline material required to precipitate out said metal present in said solution.

* * * * *